US005690583A

United States Patent [19]

Keusch

[11] Patent Number: 5,690,583

[45] Date of Patent: Nov. 25, 1997

[54] JUMP CUP ADAPTED TO BE MANIPULATED BY ONE HAND

[76] Inventor: Joseph J. Keusch, 23317 Potts Mill Rd., Middleburg, Va. 20117

[21] Appl. No.: 708,972

[22] Filed: Sep. 6, 1996

[51] Int. Cl.[6] ..... A63K 3/04; A63B 5/02

[52] U.S. Cl. ..... 482/16; 119/705; 482/15

[58] Field of Search ..... 482/14–17; 119/705; 248/219.1, 219.4, 218.4; 211/190, 103, 208

[56] References Cited

U.S. PATENT DOCUMENTS

| | | | |
|---|---|---|---|
| 3,127,144 | 3/1964 | Warner | 248/218.4 |
| 3,514,062 | 5/1970 | Gordon | 482/16 |
| 3,749,344 | 7/1973 | Racina | 248/218.4 |
| 4,239,168 | 12/1980 | Colonna Des Princes | 482/17 |

FOREIGN PATENT DOCUMENTS

| | | | |
|---|---|---|---|
| 2495489 | 6/1982 | France | 119/705 |

*Primary Examiner*—Jerome Donnolly
*Assistant Examiner*—Denise Pothier
*Attorney, Agent, or Firm*—Burns, Doane, Swecker & Mathis, L.L.P.

[57] ABSTRACT

A jump cup for supporting an end of a jump pole used in equestrian activities includes a curved plate forming an upwardly facing concave surface. A lateral support pin and a mounting pin are fixed to the plate and project from a rear side thereof. The mounting pin includes an axle portion that can be inserted into a hole of a conventional jump standard, the axle portion defining an axis about which the plate can pivot downwardly once the lateral support pin has passed across a front surface of the standard, whereby the standard is straddled by the lateral support pin and a portion of the mounting pin. The jump cup is formed of fixedly interconnected parts and can be installed or removed with one hand of a user.

5 Claims, 2 Drawing Sheets

JUMP CUP ADAPTED TO BE MANIPULATED BY ONE HAND

BACKGROUND OF THE INVENTION

The present invention relates to jump cups which support a jump pole over which horses jump during equestrian activities.

A conventional jump 10 for equestrian activities, depicted in FIG. 1, includes a series of horizontal jump poles 12 each supported at each end by a jump standard 16. Each end of a pole 12 rests on a concave plate 18 of a jump cup 20 which is fastened to a respective standard 16. The jump cup includes the plate 18 and a U-shaped piece having a pair of rearwardly projecting flanges 22 straddling a respective standard 16. The flanges include mutually aligned apertures 24 that can be selectivity aligned with one of a plurality of vertically spaced holes 26 formed through side surfaces 16S of the standard 16. A separate L-shaped fastening pin or rod 28 is insertable through the aligned apertures 24 and hole 26 to secure the cup at a selected elevation.

In order to adjust the elevation of the jump, it is necessary to vertically adjust the top pole, and possibly one or more of the other poles. That means that one or more jump cups on each standard must be raised or lowered. Doing that is relatively inconvenient with the prior art jump cup of FIG. 1, because two hands of the user are required to hold the cup while removing and re-inserting the fastening rod 28. That means that the pole 12 must be set on the ground and then picked-up after the cup has been adjusted, or the user must undergo an awkward maneuver to hold the end of the pole 12 while adjusting the cup.

Also, the fastening rods 28 tend to become lost and are not readily available when needed. Even in the case where a chain is used to loosely attach the fastener rod to the cup, the chain can eventually become broken. Also, the chain does not eliminate the need to use two hands to adjust the cup.

The flanges 22 of the cup have a tendency to become bent, whereby it becomes difficult to properly align the aperture 24 with the holes 26 for receiving the fastener rod.

Another prior art arrangement (not shown) involves attaching a vertical plate to a front surface 16F of the standard, the plate having a plurality of horizontal slots spaced apart in a vertical direction. Each jump cup would be provided with a hook that can be inserted into a selected slot in order to fasten the jump cup to the standard at selected elevations. Although such a cup can be manipulated by only one hand of the user, it is required that the standards be modified by mounting slotted brackets thereto, which is expensive and time consuming.

It would be desirable to provide a jump cup which can be manipulated by only one hand of a user, and which does not require that modifications be made to the traditional jump standards.

SUMMARY OF THE INVENTION

The present invention relates to a jump cup adapted to be selectively mounted in one of a plurality of horizontal holes spaced vertically apart in a jump standard. The jump cup comprises a curved plate forming an upwardly facing concave surface adapted to support an end of a horizontal jump pole, as well as a lateral support member and a mounting member both projecting from a rear side of the plate. The mounting member includes both a lateral support portion spaced horizontally from the lateral support member, and a horizontal mounting axle portion extending transversely from an end of the lateral support portion. The mounting axle portion is adapted for insertion into a hole of a jump standard to define a rotary axis permitting the plate to be tilted to an upper position permitting the lateral support member to pass across a front surface of the jump standard during insertion of the mounting axle into the hole, and then to swing down to a downward position such that the rear side of the plate engages the front surface of the standard, with the standard being straddled by the lateral support member and the lateral support portion.

BRIEF DESCRIPTION OF THE DRAWING

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
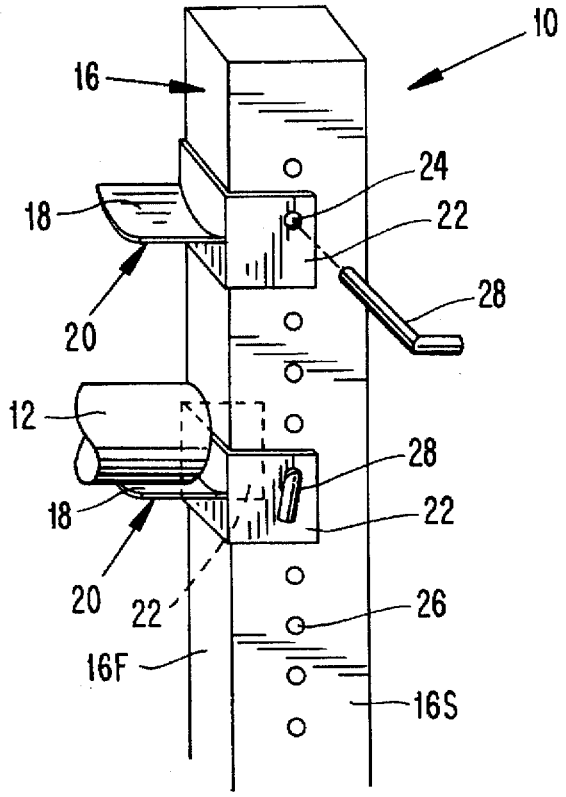
FIG. 1 (PRIOR ART)
FIG. 1 is a perspective view of a conventional jump standard carrying a conventional jump cup for supporting an end of a jump pole.
Figure 2:
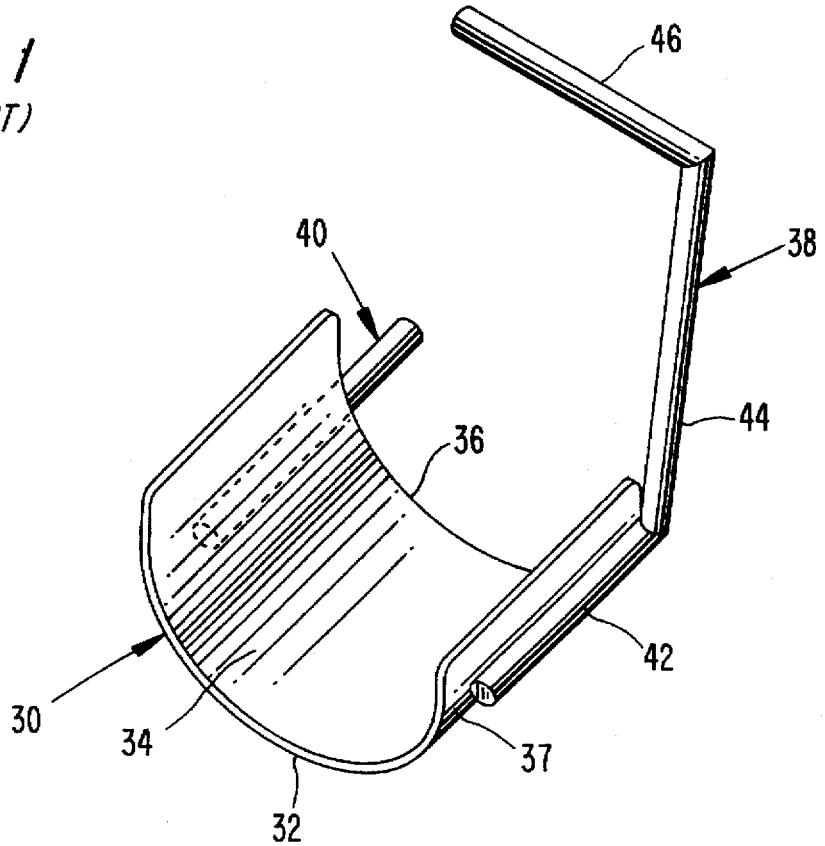
FIG. 2 is a top perspective view of a jump cup according to the present invention.
Figure 4:
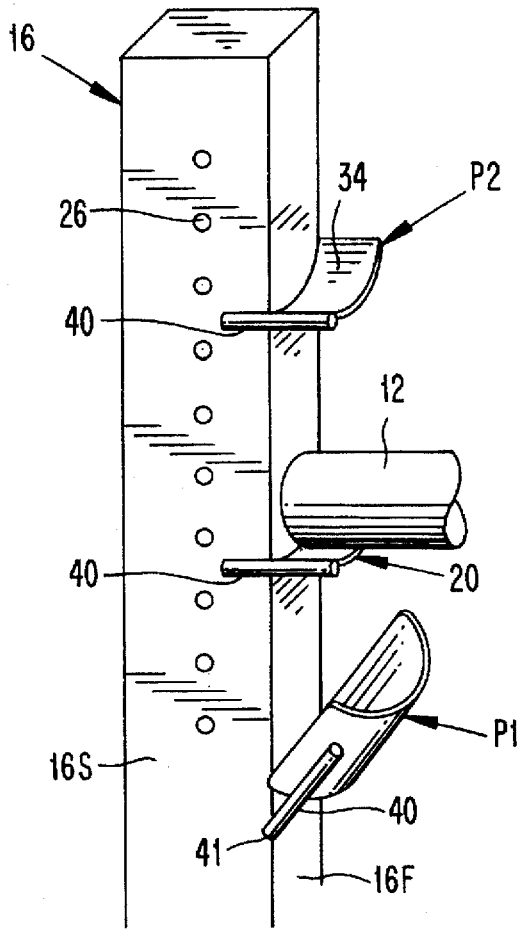
FIG. 4 is a view similar to FIG. 3 of an opposite side of the jump standard.
Figure 3:
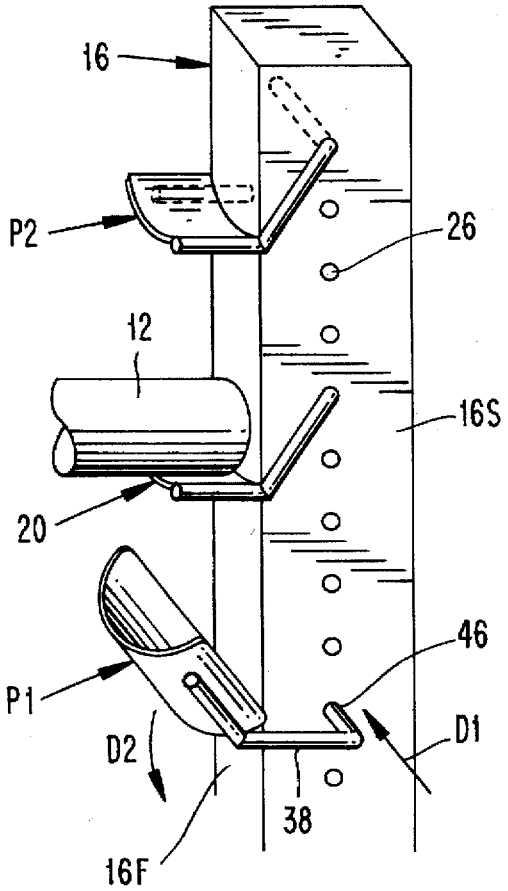
FIG. 3 is a view similar to FIG. 1 depicting the manner of mounting the jump cup of the present invention to a jump standard.

A jump cup 30 according to the present invention is depicted in FIGS. 2–4. That cup comprises a curved plate 32 forming an upwardly facing concave surface 34 for supporting an end of a jump pole 12. Projecting from a rear side 36 of the plate 32 are a mounting pin 38 and a lateral support pin 40. The pins 38, 40 are rigid members and are fixedly (immovably) secured to the underside 37 of the plate 32, e.g., by being welded thereto.

The mounting pin 38 includes a first section 42 extending from the plate in a direction generally parallel to the lateral support pin 40, a second section 44 slanted upwardly from an end of the lateral support section 42, and a horizontal third section 46 extending transversely from an end of the second section 44 in a direction orthogonal to the first section 42. The first and second sections 42, 44 lie in a common vertical plane and together define a lateral support portion of the mounting pin 38. The third section 46 defines a mounting axle portion as will be explained. The lateral support portion 42, 44 is spaced horizontally from the lateral support pin 40 by a distance slightly greater than a dimension of the standard 16 between the two side surfaces 16S thereof.

To install the cup 30 into a hole 26 of the standard 16, the cup 30 is tilted such that the plate 32 is oriented in an upper position P1 shown in FIGS. 3 and 4, with a free end 41 of the lateral support pin 40 being spaced from the plane in which a front surface 16F of the post standard lies, and the mounting axle portion 46 being aligned with a hole 26. Then, the mounting axle portion 46 is inserted through the hole 26 in direction D1, while the lateral support pin 40 passes across the front surface 16F. Once the lateral support pin 40 has passed completely across the front surface 16F, i.e., when the lateral support portion 42, 44 of the other pin 38 abuts against its respective side surface 16S of the standard, the plate 32 is allowed to swing downwardly in direction D2 toward the front surface 16F about a horizontal axis defined by the mounting axle position 46. Finally, the rear side 36 of the plate 32 comes to rest in position P2 against the front surface 16F, whereby the lateral support pin 40 and the lateral support portion 42, 44 of the pin 38 straddle the standard to prevent the axle mounting portion 46 from being dislodged from the hole 26 by a lateral force applied against the cup in a direction parallel to the mounting axle portion 46.

Removal of the cup 30 is accomplished by reversing the above-described steps.

It will be appreciated that the above-described steps can be performed by a user using only one hand. That means that the user's other hand is free to hold the end of the post 12. Hence, the adjustment of a jump cup is considerably simplified. Also, there is no separate fastener such as the earlier-described rod 28 which could become lost.

It will also be appreciated that the present invention does not require that any modifications be made to the traditional jump standards 16 in order to accommodate the jump cup 30.

The cup 30 can be formed of any suitably rigid material, such as metal or plastic. The pins 38 and 40 are preferably welded to the plate 32, although it is possible that the pins 38, 40 could be otherwise mounted on the plate, as long as those pins are rigid (immovable) relative to the plate once mounted thereon. The pin 38 is preferably of cylindrical cross section, since the portion 46 thereof constitutes a rotary axle, but the pin 40 can be of any suitable shape.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

I claim:

1. A jump cup adapted to be selectively mounted in one of a plurality of horizontal holes spaced vertically apart in a jump standard, the jump cup comprising:

a curved member, forming an upwardly facing concave surface adapted to support an end of a jump pole; and a lateral support member and a mounting member both being rigidly connected directly to the curved member and both projecting rearwardly beyond a rear side of the curved member, the mounting member including both a lateral support portion spaced horizontally from the lateral support member, and a horizontal mounting axle portion integral with and extending transversely from an end of the lateral support portion, the mounting axle portion being adapted for insertion into a hole of a jump standard to define a rotary axis permitting the curved member to be tilted to a first position enabling the lateral support member to pass across a front surface of the standard during insertion of the mounting axle into the hole, and then to be swung to a downward position such that the rear side of the curved member engages the front surface of the standard, with the front surface being straddled by the lateral support member and lateral support portion.

2. The jump cup according to claim 1 wherein the plate is formed of metal, and the lateral support member and mounting member are both formed of metal and are welded to an underside of the plate.

3. The jump cup according to claim 1 wherein the lateral support portion includes first and second sections forming an angle relative to one another and lying in a common vertical plane.

4. The jump cup according to claim 3 wherein the first section extends parallel to the lateral support member, and the second section extends upwardly at an angle with respect to vertical.

5. The jump cup according to claim 1 wherein the mounting member comprises a bent cylindrical pin.

* * * * *